US012577760B2

(12) United States Patent
Kyozu et al.

(10) Patent No.: US 12,577,760 B2
(45) Date of Patent: Mar. 17, 2026

(54) WORK MACHINE, METHOD FOR CONTROLLING WORK MACHINE, AND CONTROL SYSTEM FOR WORK MACHINE

(71) Applicant: KOMATSU LTD., Tokyo (JP)

(72) Inventors: Akihiro Kyozu, Tokyo (JP); Takeshi Kamimae, Tokyo (JP)

(73) Assignee: KOMATSU LTD., Tokyo (JP)

( * ) Notice: Subject to any disclaimer, the term of this patent is extended or adjusted under 35 U.S.C. 154(b) by 109 days.

(21) Appl. No.: 18/697,597

(22) PCT Filed: Nov. 11, 2022

(86) PCT No.: PCT/JP2022/042066
§ 371 (c)(1),
(2) Date: Apr. 1, 2024

(87) PCT Pub. No.: WO2023/145196
PCT Pub. Date: Aug. 3, 2023

(65) Prior Publication Data
US 2024/0410138 A1 Dec. 12, 2024

(30) Foreign Application Priority Data
Jan. 28, 2022 (JP) ..... 2022-012010

(51) Int. Cl.
*E02F 9/26* (2006.01)
*E02F 9/20* (2006.01)

(52) U.S. Cl.
CPC ..... *E02F 9/265* (2013.01); *E02F 9/205* (2013.01)

(58) Field of Classification Search
CPC ..... E02F 3/76; E02F 3/80; E02F 9/205; E02F 9/24; E02F 9/26; E02F 9/265
See application file for complete search history.

(56) References Cited

U.S. PATENT DOCUMENTS 5,198,800 A * 3/1993 Tozawa ..... E02F 9/2033 340/685
9,333,915 B2 * 5/2016 Nakanishi ..... B60R 1/27
(Continued)

FOREIGN PATENT DOCUMENTS

JP 62-275603 A 11/1987
JP 2018-95359 A 6/2018
(Continued)

OTHER PUBLICATIONS

The International Search Report for the corresponding international application No. PCT/JP2022/042066, issued on Dec. 20, 2022.

*Primary Examiner* — Tyler J Lee
(74) *Attorney, Agent, or Firm* — Spencer Fane LLP

(57) ABSTRACT

A work machine includes a vehicle body, a work implement, an attitude sensor, an object sensor, and a controller. The work implement is movably attached to the vehicle body. The attitude sensor detects the attitude of the work implement. The object sensor is attached to the work implement. The object sensor detects an object in a periphery of the work machine, and outputs a signal indicating a presence of the object. The controller sets a detection determination range of the object sensor. The controller determine the presence of the object in the detection determination range based on the signal from the object sensor. The controller calculates sensor attitude data including at least one of a position and an orientation of the object sensor, based on the attitude of the work implement. The controller modifies the detection determination range in accordance with the sensor attitude data.

17 Claims, 13 Drawing Sheets

(56) References Cited

U.S. PATENT DOCUMENTS

| | | | | |
|---|---|---|---|---|
| 12,188,204 | B2 * | 1/2025 | Hagiwara | E02F 9/2033 |
| 12,227,922 | B2 * | 2/2025 | Saito | E02F 9/261 |
| 2013/0088593 | A1 * | 4/2013 | Ishimoto | E02F 9/226 348/143 |
| 2013/0222573 | A1 * | 8/2013 | Onuma | E02F 9/24 348/82 |
| 2014/0100712 | A1 * | 4/2014 | Nomura | E02F 9/264 701/1 |
| 2014/0178166 | A1 * | 6/2014 | Andruch, III | E02F 3/436 414/815 |
| 2016/0005286 | A1 * | 1/2016 | Kiyota | E02F 9/262 340/435 |
| 2017/0284066 | A1 * | 10/2017 | Imaizumi | E02F 9/261 |
| 2018/0258616 | A1 * | 9/2018 | Kiyota | G06T 1/00 |
| 2019/0170879 | A1 * | 6/2019 | Kinoshita | G01B 21/18 |
| 2019/0292024 | A1 | 9/2019 | Ishikawa et al. | |
| 2019/0352885 | A1 * | 11/2019 | Kurokami | B66C 23/88 |
| 2020/0217049 | A1 * | 7/2020 | Mizuochi | H04W 4/025 |
| 2020/0291614 | A1 * | 9/2020 | Kiyota | B60R 1/23 |
| 2021/0010236 | A1 * | 1/2021 | Nishi | E02F 9/2292 |
| 2021/0174660 | A1 * | 6/2021 | Kamimura | G08B 5/36 |
| 2021/0262203 | A1 * | 8/2021 | Fujiwara | E02F 9/262 |
| 2022/0266841 | A1 | 8/2022 | Shintani et al. | |
| 2022/0333345 | A1 * | 10/2022 | Hagiwara | E02F 9/262 |
| 2023/0137344 | A1 * | 5/2023 | Saito | E02F 9/261 701/50 |
| 2023/0189784 | A1 * | 6/2023 | Montgomery | A01M 7/0089 701/49 |

FOREIGN PATENT DOCUMENTS

| | | | |
|---|---|---|---|
| JP | 2020-103102 | A | 7/2020 |
| JP | 2020-175890 | A | 10/2020 |
| JP | 2021-26349 | A | 2/2021 |
| JP | 2021-93984 | A | 6/2021 |
| KR | 10-2021-0105138 | A | 8/2021 |

* cited by examiner

WORK MACHINE, METHOD FOR CONTROLLING WORK MACHINE, AND CONTROL SYSTEM FOR WORK MACHINE

CROSS-REFERENCE TO RELATED APPLICATIONS

This application is a U.S. National stage application of International Application No. PCT/JP2022/042066, filed on Nov. 11, 2022. This U.S. National stage application claims priority under 35 U.S.C. § 119 (a) to Japanese Patent Application No. 2022-012010, filed in Japan on Jan. 28, 2022, the entire contents of which are hereby incorporated herein by reference.

BACKGROUND

Technical Field

The present invention relates to a work machine, a method for controlling the work machine, and a control system for the work machine.

Background Information

Conventionally, a technique for detecting a nearby person or obstacle with an object sensor such as a radar is used in work machines. For example, the work machine of Japanese Patent Laid-open No. 2021-26349 includes a rearward sensor. This work machine includes a vehicle body and a work implement. The work implement is attached to the rear section of the vehicle body so as to be able to move up and down. The rearward sensor is attached to the work implement and detects an obstacle to the rear of the work implement.

SUMMARY

The work implement is attached to the vehicle body in the abovementioned work machine. If the object sensor were attached to the vehicle body, the detection range of the object sensor would be reduced because the work implement enters the detection range of the object sensor in the abovementioned work machine. As a result, the object sensor is desirably attached to the work implement.

On the other hand, if the work implement is movable, the attitude of the work implement changes in accordance with the motion of the work implement. Therefore, when the object sensor is attached to the work implement, the position or the orientation of the object sensor changes in accordance with the change of the attitude of the work implement. In this case, it is difficult to appropriately detect an object in the periphery of the work machine due to the change in the detection range of the object sensor. For example, if the position of the object sensor changes upward due to a change in the attitude of the work implement, the blind spot below the object sensor becomes larger. An object of the present invention is to assure a wide detection range for an object sensor and appropriately detect an object in the periphery of a work machine even if the attitude of the work implement changes.

A work machine according to a first aspect of the present invention includes a vehicle body, a work implement, an attitude sensor, an object sensor, and a controller. The work implement is movably attached to the vehicle body. The attitude sensor detects the attitude of the work implement. The object sensor is attached to the work implement. The object sensor detects an object in the periphery of the work machine. The object sensor outputs a signal indicating the presence of an object.

The controller sets a detection determination range of the object sensor. The controller determines the presence of an object in the detection determination range based on the signal output by the object sensor. The controller calculates sensor attitude data based on the attitude of the work implement. The sensor attitude data includes at least one of the position and orientation of the object sensor. The controller modifies the detection determination range in accordance with the sensor attitude data.

A method according to a second aspect of the present invention is a method for controlling a work machine. The work machine includes a vehicle body, a work implement, and an object sensor. The work implement is attached to the vehicle body in a manner that allows movement. The object sensor is attached to the work implement. The object sensor detects an object in the periphery of the work machine. The object sensor outputs a signal indicating the presence of an object. The method according to the present aspect includes: detecting the attitude of the work implement; setting a detection determination range of the object sensor; determining the presence of an object in the detection determination range based on the signal output by the object sensor; calculating sensor attitude data that includes at least one of the position and orientation of the object sensor, based on the attitude of the work implement; and modifying the detection determination range in accordance with the sensor attitude data.

A control system according to a third aspect of the present invention is a control system for a work machine. The work machine includes a vehicle body and a work implement. The work implement is attached to the vehicle body in a manner that allows movement. The control system according to the present aspect includes an attitude sensor, and object sensor, and a controller. The attitude sensor detects the attitude of the work implement. The object sensor is attached to the work implement. The object sensor detects an object in the periphery of the work machine. The object sensor outputs a signal indicating the presence of an object. The controller sets a detection determination range of the object sensor. The controller determines the presence of an object in the detection determination range based on a signal output by the object sensor. The controller calculates sensor attitude data based on the attitude of the work implement. The sensor attitude data includes at least one of the position and orientation of the object sensor. The controller modifies the detection determination range in accordance with the sensor attitude data.

In the present invention, the object sensor is attached to the work implement in the work machine. As a result, it can be assured that the detection range of the object sensor is wider in comparison to a situation in which the object sensor is attached to the vehicle body. In addition, the sensor attitude data that includes at least one of the position and orientation of the object sensor is calculated based on the attitude of the work implement. The detection determination range of the object sensor is then modified in accordance with the sensor attitude data. Therefore, if the position or orientation of the object sensor changes due to a change in the attitude of the work implement, the detection determination range of the object sensor is modified in accordance with the change in the position or orientation of the object sensor. Consequently, the detection determination range is appropriately modified in accordance with the change in the attitude of the work implement whereby an object in the periphery of the work machine can be appropriately detected.

DETAILED DESCRIPTION OF EMBODIMENT(S)

Figure 1:
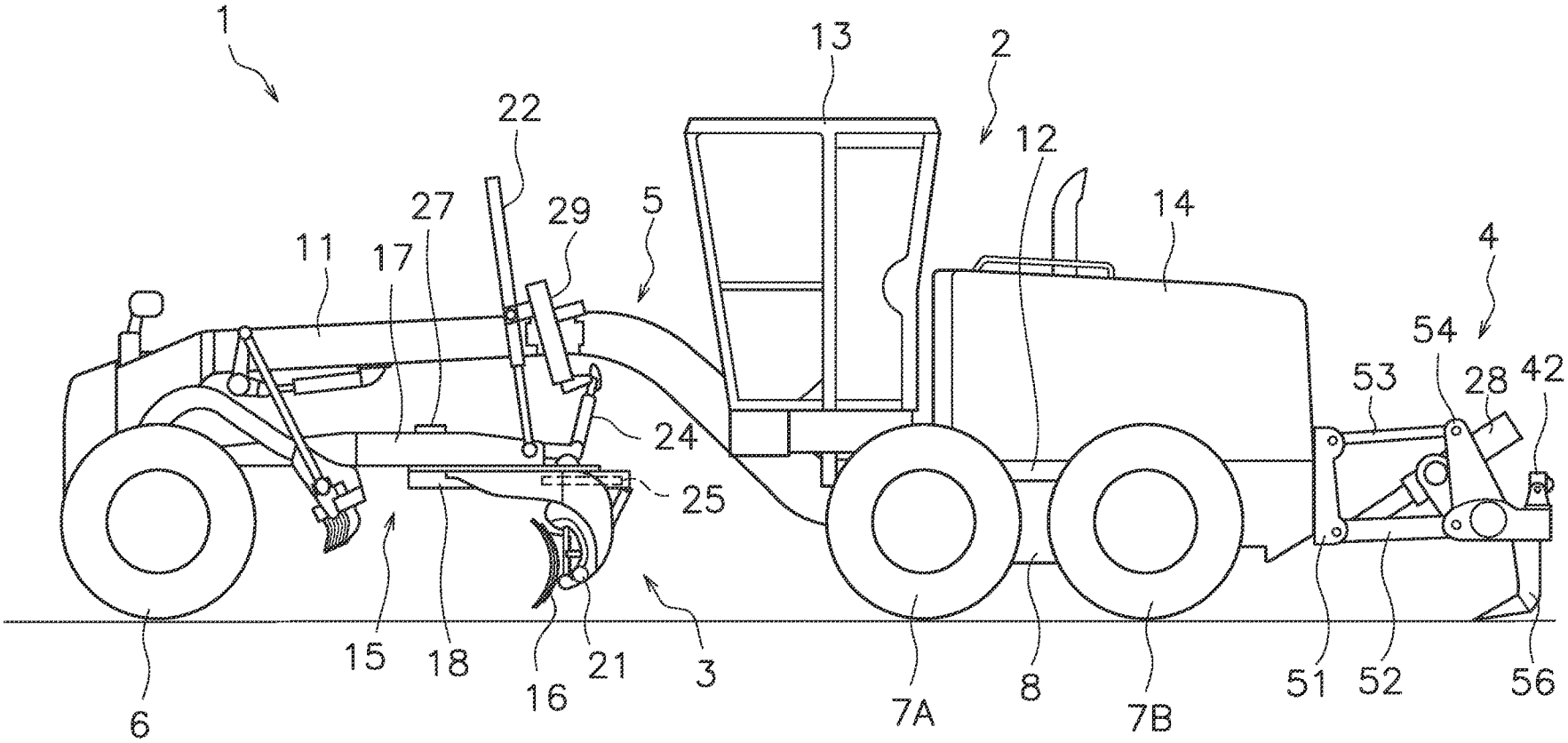
FIG. 1 is a side view of a work machine according to an embodiment.
Figure 2:
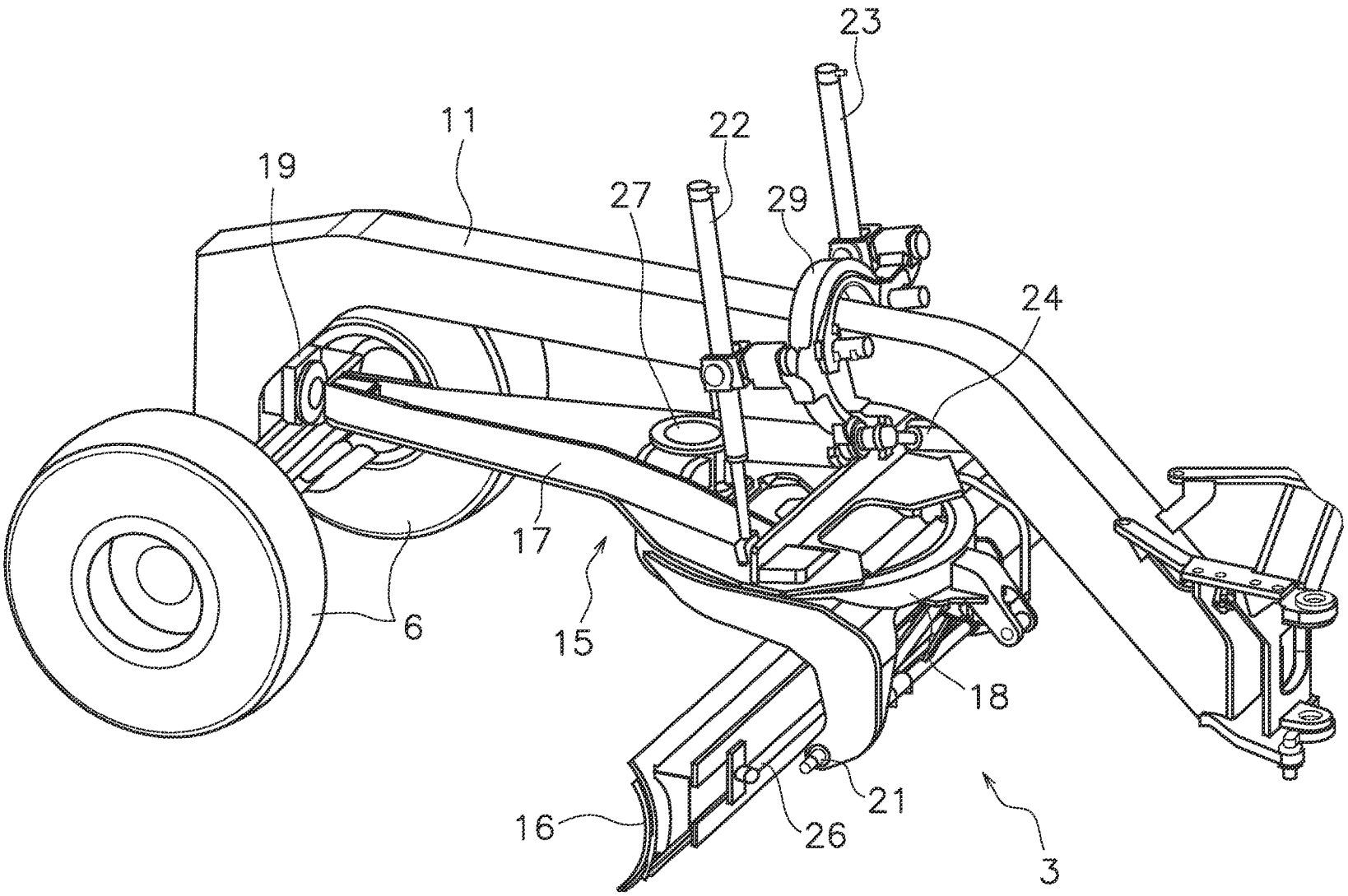
FIG. 2 is a perspective view of a front part of the work machine.

An embodiment of the present invention will be described below with reference to the drawings. FIG. 1 is a side view of a work machine 1 according to the embodiment. FIG. 2 is a perspective view of a front part of the work machine 1. The work machine 1 according to the present embodiment is a motor grader. As illustrated in FIG. 1, the work machine 1 includes a vehicle body 2, a first work implement 3, and a second work implement 4. The first work implement 3 is attached to the vehicle body 2. The second work implement 4 is attached to a rear part of the vehicle body 2. The first work implement 3 and the second work implement 4 are movable with respect to the vehicle body 2. The vehicle body 2 includes a vehicle body frame 5, front wheels 6, rear wheels 7A and 7B, and a tandem drive 8. In the present embodiment, the first work implement 3 includes a blade 16 disposed between the front wheels 6 and the rear wheels 7A. The second work implement 4 is attached further toward the rear than the rear end of the vehicle body 2. In the present embodiment, the second work implement 4 is a ripper and includes a tooth 56 disposed to the rear of the rear wheels 7B.

The vehicle body frame 5 includes a front frame 11 and a rear frame 12. The rear frame 12 is connected to the front frame 11. The front frame 11 is configured to articulate to the left and right with respect to the rear frame 12. In the following explanation, the front, rear, left, and right directions signify the front, rear, left, and right directions of the vehicle body 2 while the articulate angle is zero, that is while the front frame 11 and the rear frame 12 are straight.

A cab 13 and a power chamber 14 are disposed on the rear frame 12. An unillustrated operator's seat is disposed in the cab 13. A belowmentioned drive system is disposed in the power chamber 14. The front frame 11 extends toward the front from the rear frame 12. The front wheels 6 are attached to the front frame 11. The tandem drive 8 is connected to the rear frame 12. The tandem drive 8 supports the rear wheels 7A and 7B and also drives the rear wheels 7A and 7B. Only the rear wheels 7A and 7B on the left side are illustrated in FIG. 1.

The first work implement 3 is movably connected to the vehicle body 2. The first work implement 3 includes a supporting member 15 and the blade 16. The supporting member 15 is movably connected to the vehicle body 2. The supporting member 15 supports the blade 16. The supporting member 15 includes a drawbar 17 and a circle 18. The drawbar 17 and the circle 18 are disposed below the front frame 11.

As illustrated in FIG. 2, the drawbar 17 is connected to a pivot support 19 of the front frame 11. The pivot support 19 is disposed in the front part of the front frame 11. The drawbar 17 extends toward the rear from the front part of the front frame 11. The drawbar 17 is swingably supported at least in the up-down direction and the left-right direction of the vehicle body 2 with respect to the front frame 11. For example, the pivot support 19 includes a ball joint. The drawbar 17 is rotatably connected to the front frame 11 via the ball joint.

The circle 18 is connected to a rear part of the drawbar 17. The circle 18 is rotatably supported with respect to the drawbar 17. The blade 16 is connected to the circle 18. The blade 16 is supported by the drawbar 17 via the circle 18. The blade 16 is supported by the circle 18 so as to be rotatable about a tilt axis 21. The tilt axis 21 extends in the left-right direction. The blade 16 is supported by the circle 18 so as to be slidable in the left-right direction.

The work machine 1 includes a plurality of actuators 22 to 27 for changing the orientation of the first work implement 3. The plurality of actuators 22 to 27 include a plurality of hydraulic cylinders 22 to 26. The plurality of hydraulic cylinders 22 to 26 are connected to the first work implement 3. The plurality of hydraulic cylinders 22 to 26 extend and contract due to hydraulic pressure. The plurality of hydraulic cylinders 22 to 26 change the orientation of the first work implement 3 with respect to the vehicle body 2 by extending and contracting. In the following explanation, the extension and contraction of the hydraulic cylinders is referred to as a "stroke motion."

Specifically, the plurality of hydraulic cylinders 22 to 26 include a left lift cylinder 22, a right lift cylinder 23, a drawbar shift cylinder 24, a blade tilt cylinder 25, and a blade shift cylinder 26. The left lift cylinder 22 and the right lift cylinder 23 are disposed away from each other in the left-right direction. The left lift cylinder 22 is connected to the left portion of the drawbar 17. The right lift cylinder 23 is connected to the right portion of the drawbar 17. The left lift cylinder 22 and the right lift cylinder 23 are connected so as to be able to swing to the left and right with respect to the drawbar 17.

The left lift cylinder 22 and the right lift cylinder 23 are connected so as to be able to swing to the left and right with respect to the front frame 11. Specifically, the left lift cylinder 22 and the right lift cylinder 23 are connected to the front frame 11 via a lifter bracket 29. The lifter bracket 29 is connected to the front frame 11. The lifter bracket 29 supports the left lift cylinder 22 and the right lift cylinder 23 so as to be able to swing to the left and right. The drawbar 17 swings up and down about the pivot support 19 due to the stroke motions of the left lift cylinder 22 and the right lift cylinder 23. As a result, the blade 16 moves up and down.

The drawbar shift cylinder 24 is coupled to the drawbar 17 and the front frame 11. The drawbar shift cylinder 24 is connected to the front frame 11 via the lifter bracket 29. The drawbar shift cylinder 24 is swingably connected to the front frame 11. The drawbar shift cylinder 24 is swingably connected to the drawbar 17. The drawbar shift cylinder 24 extends diagonally downward from the front frame 11 toward the drawbar 17. The drawbar shift cylinder 24 extends to the left and right from one side to the opposite side in the left-right direction of the front frame 11. The drawbar 17 swings left and right about the pivot support 19 due to the stroke motions of the drawbar shift cylinder 24.

As illustrated in FIG. 1, the blade tilt cylinder 25 is connected to the circle 18 and the blade 16. The blade 16 rotates about the tilt axis 21 due to the stroke motions of the blade tilt cylinder 25. As illustrated in FIG. 2, the blade shift cylinder 26 is connected to the circle 18 and the blade 16. The blade 16 slides to the right and left with respect to the circle 18 due to the stroke motions of the blade shift cylinder 26.

The plurality of actuators 22 to 27 include a rotation actuator 27. The rotation actuator 27 is connected to the drawbar 17 and the circle 18. In the present embodiment, the rotation actuator 27 is a hydraulic motor. However, the rotation actuator 27 may be an electric motor. The rotation actuator 27 causes the circle 18 to rotate with respect to the drawbar 17. Consequently, the blade 16 rotates about a rotating axis that extends in the up-down direction.

As indicated above, the second work implement 4 in the present embodiment is a ripper. As illustrated in FIG. 1, the second work implement 4 includes a ripper bracket 51, links 52 and 53, a tooth bracket 54, a ripper actuator 28, and the tooth 56. The ripper bracket 51 is attached to the back surface of the vehicle body 2. The links 52 and 53 are connected to the ripper bracket 51 and the tooth bracket 54. The links 52 and 53 are rotatable with respect to the ripper bracket 51. The links 52 and 53 are rotatable with respect to the tooth bracket 54.

The tooth 56 is connected to the tooth bracket 54. The ripper actuator 28 is connected to the tooth 56 via the tooth bracket 54. The ripper actuator 28 is, for example, a hydraulic cylinder. The tooth 56 moves up and down due to the extension and contraction of the ripper actuator 28.

Figure 3:
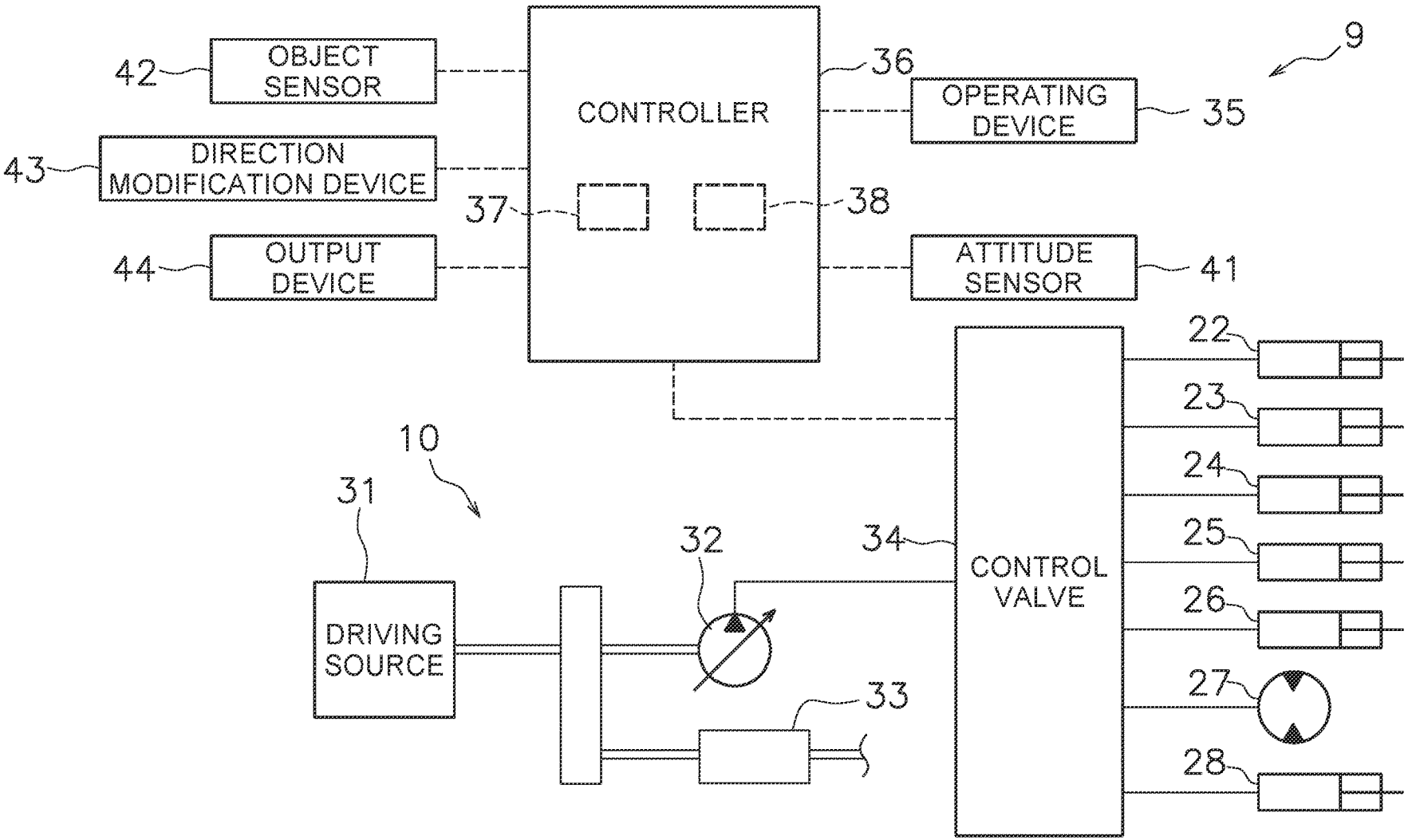
FIG. 3 is a schematic view of a drive system and a control system of the work machine.

FIG. 3 is a schematic view of a control system 9 and a drive system 10 of the work machine 1. As illustrated in FIG. 3, the work machine 1 includes a driving source 31, a hydraulic pump 32, a power transmission device 33, and a control valve 34. The driving source 31 is, for example, an internal combustion engine. Alternatively, the driving source 31 may be an electric motor or a hybrid of an internal combustion engine and an electric motor. The hydraulic pump 32 is driven by the driving source 31 thereby discharging hydraulic fluid.

The control valve 34 is connected to the hydraulic pump 32 and the plurality of actuators 22 to 28 via a hydraulic circuit. The work implement valve 34 includes a plurality of valves respectively connected to the plurality of actuators 22 to 28. The control valve 34 controls the flow rate of hydraulic fluid supplied from the hydraulic pump 32 to the plurality of actuators 22 to 28.

The power transmission device 33 transmits the driving power from the driving source 31 to the rear wheels 7A and 7B. The power transmission device 33 may include a torque converter and/or a plurality of speed change gears. Alternatively, the power transmission device 33 may be transmission of another type such as a hydrostatic transmission (HST) or a hydraulic mechanical transmission (HMT).

As illustrated in FIG. 3, the work machine 1 includes an operating device 35 and a controller 36. The operating device 35 is operable by an operator in order to modify the attitude of the first work implement 3. The attitude of the first work implement 3 indicates the position and orientation of the blade 16 with respect to the vehicle body 2. The operating member 35 includes, for example, a plurality of levers. The stroke motions of the plurality of actuators 22 to 26 and the rotation motion of the rotation actuator 27 are controlled in accordance with the operation of the operating device 35. Consequently, the attitude of the first work implement 3 is modified.

The operating device 35 is operable by an operator in order to modify the attitude of the second work implement 4. The attitude of the second work implement 4 indicates the position and orientation of the tooth 56 with respect to the vehicle body 2. The stroke motions of the ripper actuator 28 are controlled in accordance with the operation of the operating device 35. Consequently, the attitude of the second work implement 4 is modified.

The controller 36 causes the work machine 1 to travel by controlling the driving source 31 and the power transmission device 33. The controller 36 actuates the first work implement 3 by controlling the hydraulic pump 32 and the control valve 34. Additionally, the controller 36 actuates the second work implement 4 by controlling the hydraulic pump 32 and the control valve 34.

The controller 36 includes a processor 37 and a storage device 38. The processor 37 is, for example, a CPU and executes a program for controlling the work machine 1. The storage device 38 includes a memory such as a RAM or a ROM and an auxiliary storage device such as an SSD or an HDD. The storage device 38 stores programs and data for controlling the work machine 1.

As illustrated in FIG. 3, the work machine 1 includes an attitude sensor 41. The attitude sensor 41 detects the attitude of the second work implement 4. The attitude sensor 41 outputs a signal indicating the attitude of the second work implement 4. The attitude sensor 41 is, for example, an inertial measurement device (IMU) mounted to the second work implement 4. Alternatively, the attitude sensor 41 may be a sensor for detecting the angles between the links 52 and 53 and the tooth bracket 54. In this case, the controller 36 may calculate the position and orientation of the tooth 56 from the angles between the links 52 and 53 and the tooth bracket 54. Alternatively, the attitude sensor 41 may be a sensor for detecting the stroke length of the ripper actuator 28. In this case, the controller 36 may calculate the position and orientation of the tooth 56 from the stroke length of the ripper actuator 28.

As illustrated in FIG. 3, the work machine 1 includes an object sensor 42, a direction modification device 43, and an output device 44. The object sensor 42 detects an object in the periphery of the work machine 1. The object sensor 42 is, for example, a radar device such as a millimeter wave radar. Alternatively, the object sensor 42 may be another type of sensor such as an ultrasonic sensor, a camera, or a light detection and ranging (LIDAR) device. The object sensor 42 outputs a signal indicating the presence of an object in a detectable range.

As illustrated in FIG. 1, the object sensor 42 is attached to the second work implement 4 in the present embodiment. Specifically, the object sensor 42 is attached to an upper part of the tooth 56. The object sensor 42 is disposed facing the rear of the work machine 1. The object sensor 42 detects the presence of an object to the rear of the work machine 1. In this way, due to the object sensor 42 being attached to the second work implement 4, a wider detection range of the object sensor 42 is assured in comparison to the object sensor 42 being attached to the vehicle body.

As illustrated in FIG. 3, the direction modification device 43 is connected to the object sensor 42. The direction modification device 43 modifies the orientation of the object sensor 42. The direction modification device 43 includes, for example, an electric motor. The direction modification device 43 modifies the orientation of the object sensor 42 in the up-down direction and the left-right direction.

The output device 44 is, for example, a display. The output device 44 displays an image in accordance with an instruction signal from the controller 36. Alternatively, the output device 44 may be a speaker. The output device 44 may output a sound in accordance with the instruction signal from the controller 36.

The controller 36 sets the detection determination range in the periphery of the work machine 1 and determines the presence of an object in the detection determination range based on a signal from the object sensor 42. For example, the controller 36 sets the detection determination range to the rear of the vehicle body 2. The controller 36 causes the output device 44 to output an alarm when an object is detected in the detection determination range.

As indicated above, the second work implement 4 is movable with respect to the vehicle body 2. As a result, the attitude of the object sensor 42 changes in accordance with the motions of the second work implement 4. The controller modifies the detection determination range in accordance with the change in the attitude of the object sensor 42. A detection method of an object according to the first embodiment will be explained below.

Figure 4:
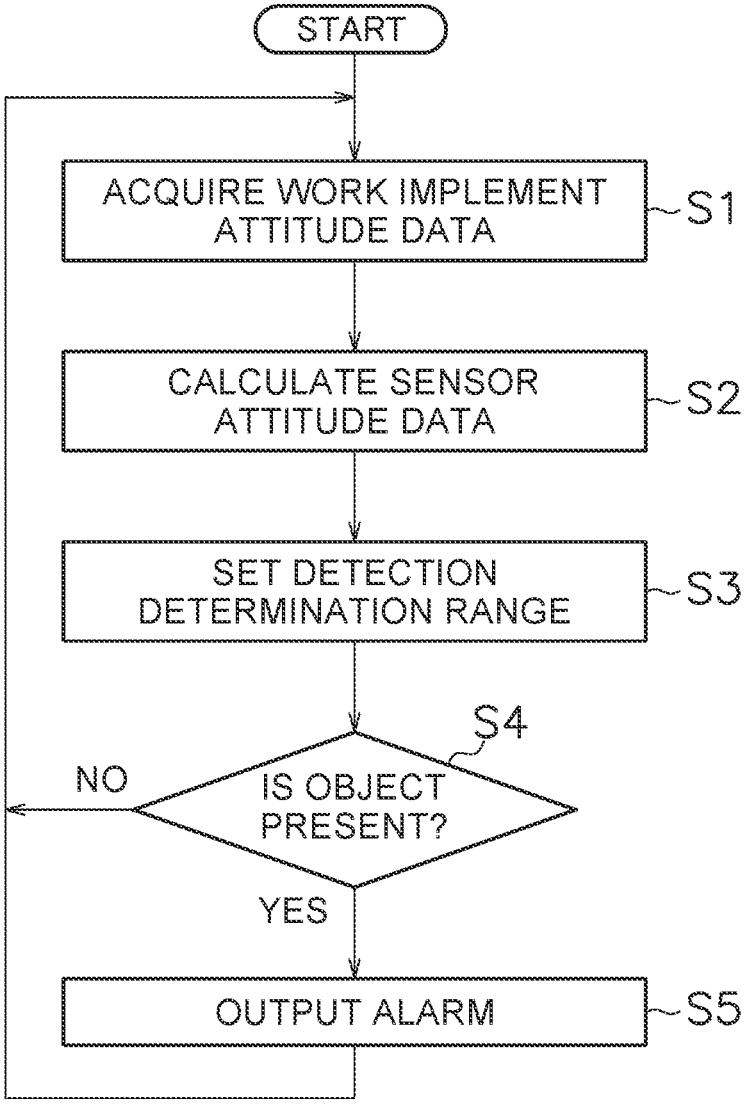
FIG. 4 is a flow chart illustrating a process for detecting an object in the periphery of the work machine.
Figure 5:
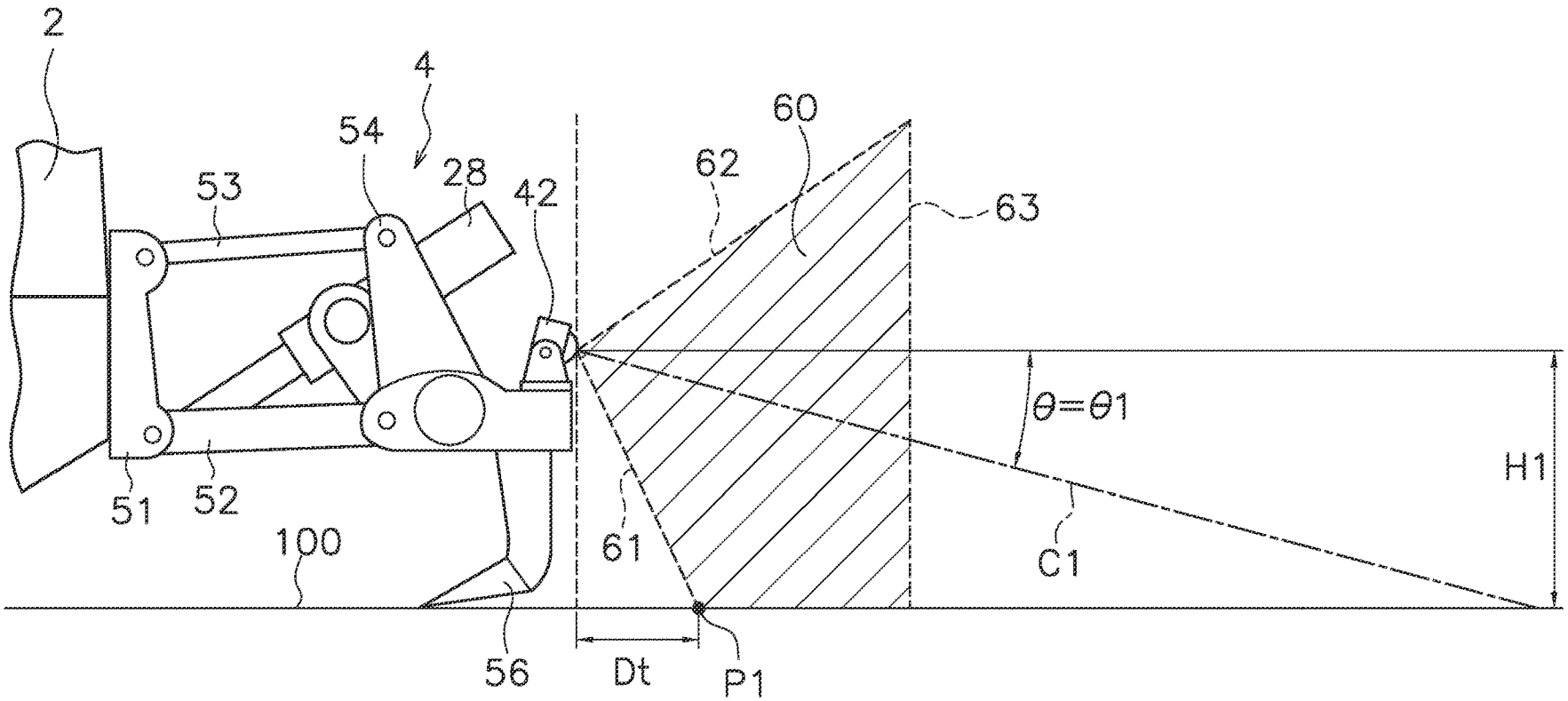
FIG. 5 is a side view illustrating a detection determination range according to a first embodiment.
Figure 6:
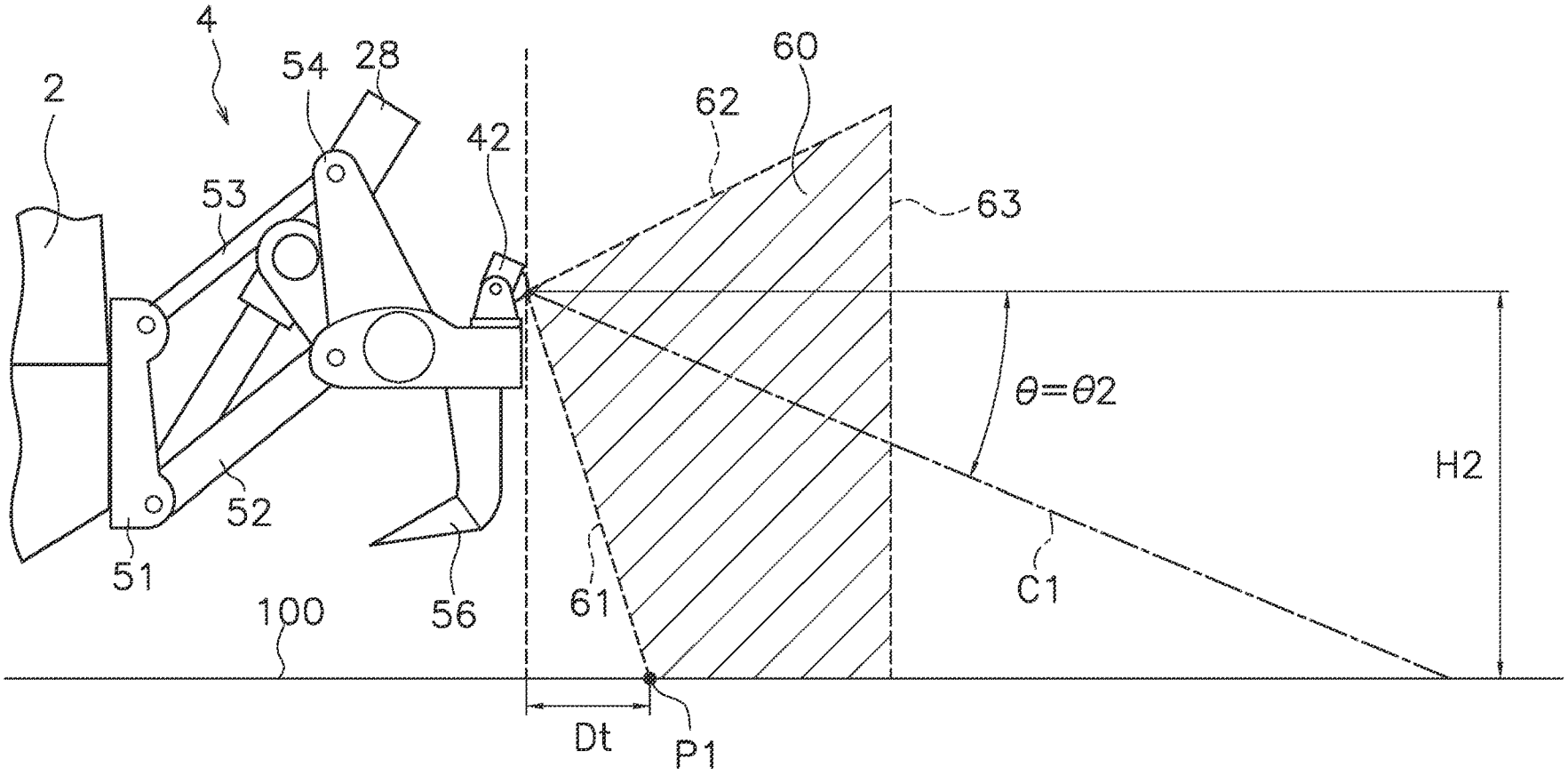
FIG. 6 is a side view illustrating the detection determination range according to the first embodiment.

FIG. 4 is a flow chart illustrating a process for detecting an object in the periphery of the work machine 1. FIGS. 5 and 6 are side views illustrating the detection determination range according to the first embodiment. As illustrated in step S1 in FIG. 4, the controller 36 acquires work implement attitude data. The work implement attitude data indicates the attitude of the second work implement 4. As illustrated in FIGS. 5 and 6, the tooth 56 of the second work implement 4 (ripper) moves up and down due to an operation by the operator. In the first embodiment, the work implement attitude data indicates the position of the tooth 56. Specifically, in the first embodiment, the work implement attitude data indicates the height of the tooth 56. The controller 36 acquires the work implement attitude data via the signal from the attitude sensor 41.

In step S2, the controller 36 calculates the sensor attitude data. As illustrated in FIG. 5, the sensor attitude data indicates the height H1 of the object sensor 42. The controller 36 calculates the height H1 of the object sensor 42 as the sensor attitude data based on the work implement attitude data.

In step S3, the controller 36 sets a detection determination range 60. The controller 36 sets the detection determination range 60 in accordance with the height H1 of the object sensor 42 indicated by the sensor attitude data. As illustrated in FIG. 5, the detection determination range 60 has a lower limit line 61, an upper limit line 62, and a rear limit line 63 as seen in the vehicle side view. The detection determination range 60 is the range surrounded by the lower limit line 61, the upper limit line 62, and the rear limit line 63.

The lower limit line 61 indicates the boundary position below the detection determination range 60. The upper limit line 62 indicates the boundary position above the detection determination range 60. The rear limit line 63 indicates the boundary position to the rear of the detection determination range 60. The detection determination range 60 is fixed with respect to the object sensor 42. The angle between the lower limit line 61 and the upper limit line 62 is a fixed value that corresponds to the sensor properties of the object sensor 42. The position of the detection determination range 60 changes in response to changes in the position and orientation of the object sensor 42.

The controller 36 modifies the orientation of the object sensor 42 by means of the direction modification device 43 in accordance with the sensor attitude data, thereby modifying the detection determination range 60. The orientation of the object sensor 42 is represented by a sensor angle θ. The sensor angle θ indicates the orientation of the object sensor 42 in the up-down direction. The sensor angle θ is the angle of a center axis C1 of the object sensor 42 with respect to the horizontal direction. The controller 36 calculates a target angle θ1 of the sensor angle θ in which the distance from the object sensor 42 to a point P1 where the lower limit line 61 and the ground surface 100 intersect, becomes a target distance Dt. The controller 36 calculates the target angle θ1 from the height H1 of the object sensor 42 and the target distance Dt. The target distance Dt is, for example, a fixed value and is stored by the controller 36. Alternatively, the target distance Dt may be variable.

The controller 36 modifies the orientation of the object sensor 42 by means of the direction modification device 43 so that the sensor angle θ becomes the target angle θ1. Consequently, as illustrated in FIG. 5, the detection determination range 60 is set so that the distance from the object sensor 42 to the point P1 becomes the target distance Dt.

In step S4, the controller 36 determines the presence of an object in the detection determination range 60 based on a signal output by the object sensor 42. When an object is in the detection determination range 60, the controller 36 causes the output device 44 to output an alarm in step S5. The process returns to step S1 and the processing from steps S1 to S5 is repeated.

As illustrated in FIG. 6, when the second work implement 4 is actuated so that the tooth 56 rises, the controller 36 acquires the height of the tooth 56 in step S1. The controller 36 calculates the height H2 of the object sensor 42 from the height of the tooth 56 in step S2. In step S3, the controller 36 sets the detection determination range 60 based on the height H2 of the object sensor 42. The controller 36 calculates a target angle θ2 of the sensor angle θ in which the distance from the object sensor 42 to the point P1 becomes the target distance Dt. The controller 36 calculates the target angle θ2 from the height H2 of the object sensor 42 and the target distance Dt.

The controller 36 modifies the orientation of the object sensor 42 by means of the direction modification device 43 so that the sensor angle θ becomes the target angle θ2. Consequently, as illustrated in FIG. 6, the controller 36 modifies the detection determination range 60 so that the distance from the object sensor 42 to the point P1 is maintained at the target distance Dt even if the height of the object sensor 42 changes from H1 to H2. That is, the controller 36 modifies the detection determination range 60 so as to reduce the change of the detection determination range 60 brought about by the change in the height of the object sensor 42.

In the detection method for an object according to the first embodiment as explained above, the controller 36 modifies the orientation of the object sensor 42 by means of the direction modification device 43 in accordance with the change in the height of the object sensor 42 brought about by the change in the attitude of the second work implement 4, thereby modifying the detection determination range 60. As a result, an increase in the blind spot of the detection determination range 60 is suppressed even if the attitude of the second work implement 4 changes. Consequently, an object in the periphery of the work machine 1 can be appropriately detected.

Figure 7:
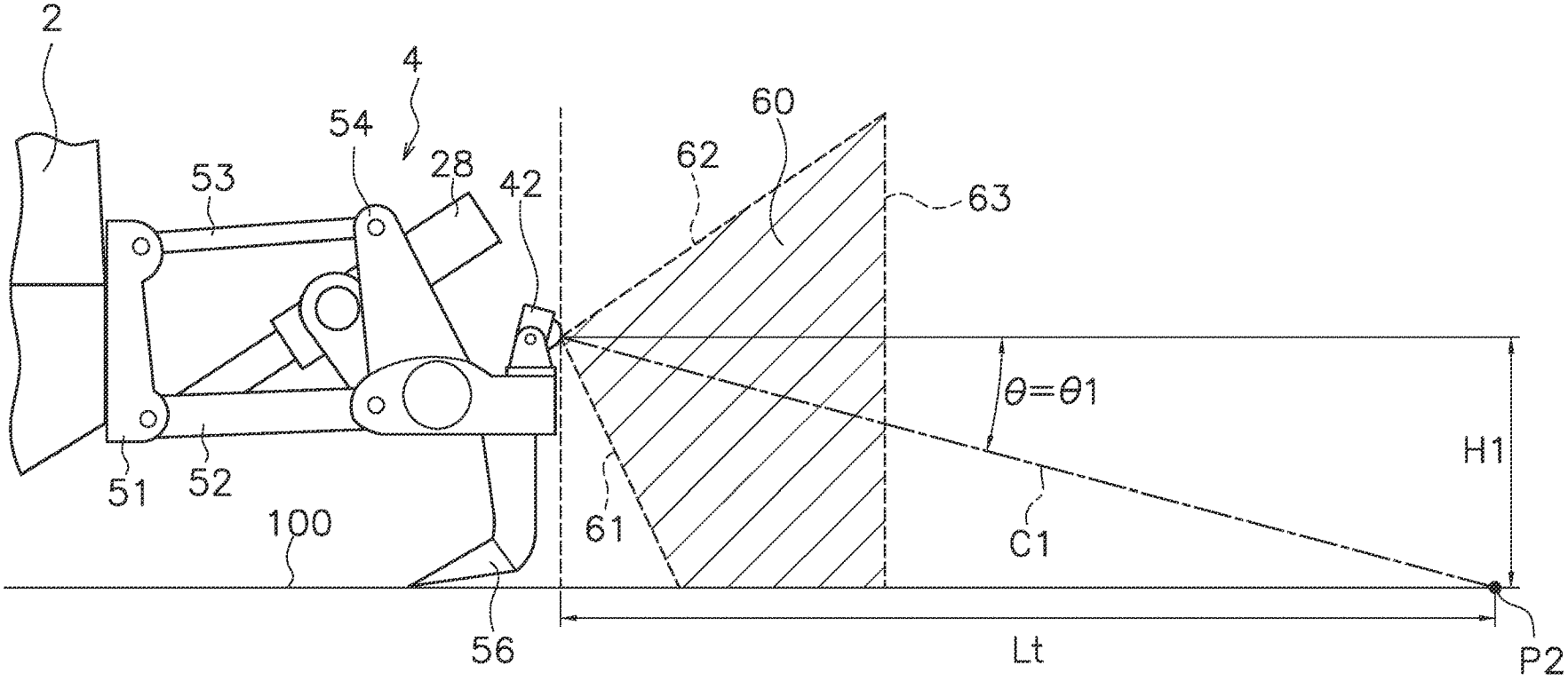
FIG. 7 is a side view illustrating the detection determination range according to a modified example of the first embodiment.

FIG. 7 is a side view illustrating the detection determination range 60 according to a modified example of the first embodiment. As illustrated in FIG. 7, the controller 36 calculates the target angle θ1 of the sensor angle θ in which the distance from the object sensor 42 to a point P2 where the center axis C1 of the object sensor 42 and the ground surface 100 intersect, becomes a target distance Lt.

Figure 8:
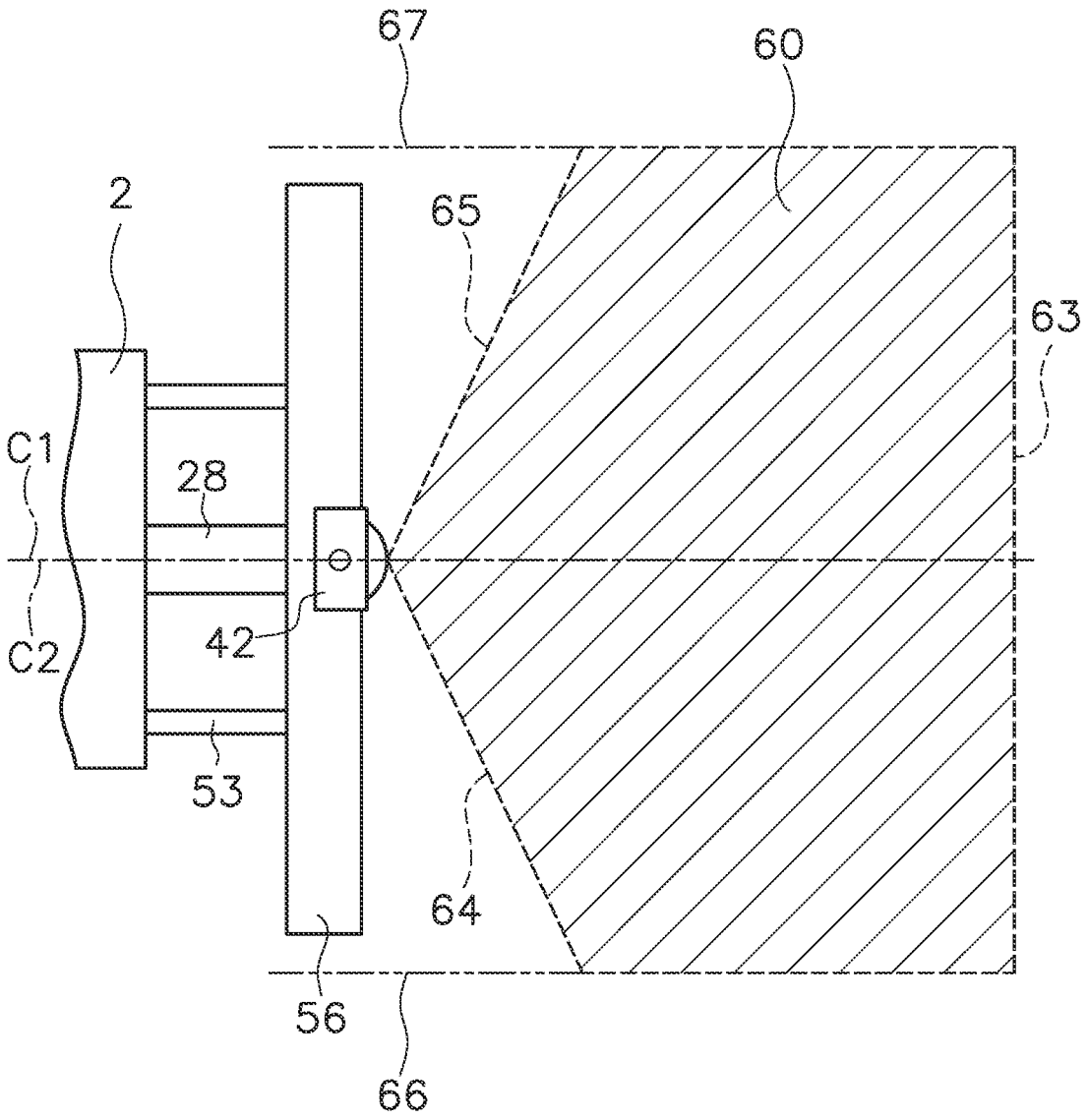
FIG. 8 is a top view illustrating the detection determination range according to a second embodiment.
Figure 9:
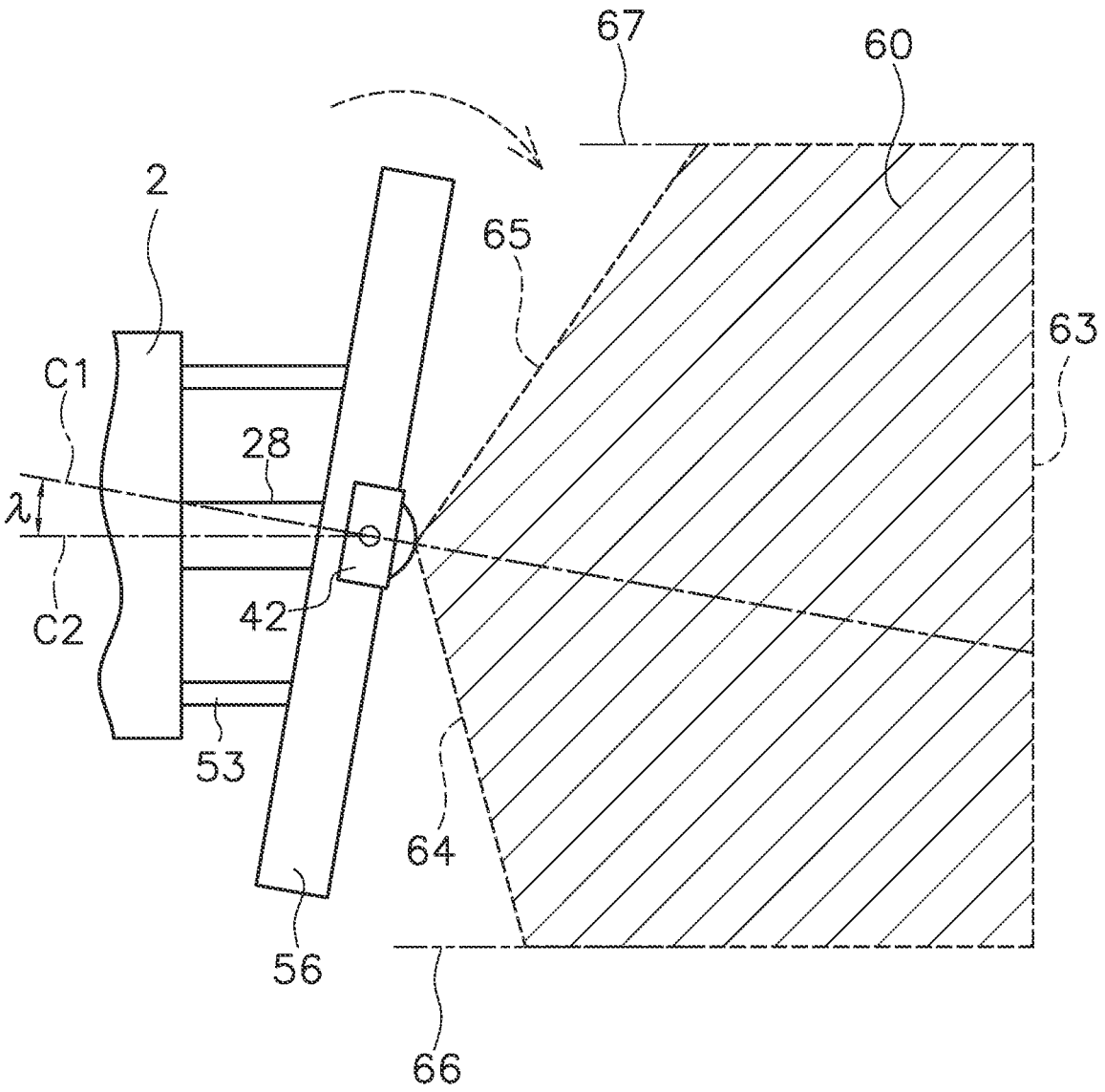
FIG. 9 is a top view illustrating the detection determination range according to the second embodiment.
Figure 10:
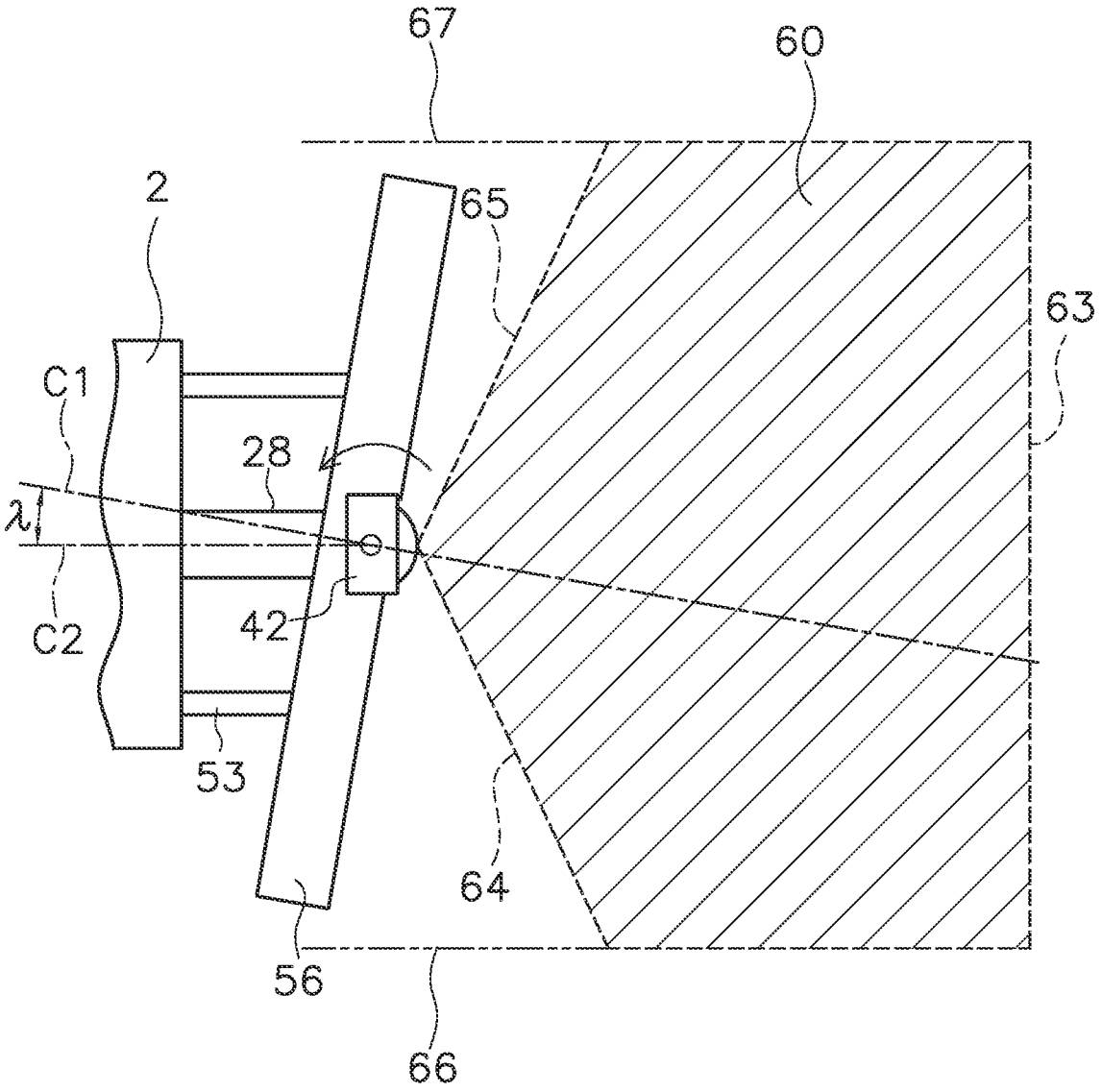
FIG. 10 is a top view illustrating the detection determination range according to the second embodiment.

Next, a detection method of an object according to a second embodiment will be explained below. FIGS. 8 to 10 are top views illustrating the detection determination range 60 according to the second embodiment. The flow chart that illustrates the detection method for the object according to the second embodiment is the same as the flow chart that illustrates the detection method for the object according to the first embodiment illustrated in FIG. 4.

In step S1, the controller 36 acquires the work implement attitude data. As illustrated in FIGS. 8 and 9, the tooth 56 of the second work implement 4 (ripper) rotates to the left and right due to an operation by the operator. Therefore, in the second embodiment, the work implement attitude data indicates the orientation of the tooth 56 in the left-right direction. That is, the work implement attitude data is the rotation angle in the left-right direction of the tooth 56.

In step S2, the controller 36 calculates the sensor attitude data. As illustrated in FIG. 9, the sensor attitude data indicates a sensor angle λ of the object sensor 42. The sensor angle λ indicates the orientation of the object sensor 42 in the left-right direction. The sensor angle λ is the angle of the center axis C1 of the object sensor 42 with respect to a center line C2 of the vehicle body 2. The controller 36 calculates the sensor angle λ of the object sensor 42 as the sensor attitude data based on the work implement attitude data.

In step S3, the controller 36 sets a detection determination range 60. The controller 36 sets the detection determination range 60 in accordance with the orientation of the object sensor 42 indicated by the sensor attitude data. As illustrated in FIG. 8, the detection determination range 60 includes a left limit line 64 and a right limit line 65. The left limit line 64 indicates the boundary position to the left of the detection determination range 60. The left limit line 64 is set so as not to exceed a left outermost line 66. The right limit line 65 indicates the boundary position to the right of the detection determination range 60. The right limit line 65 is set so as not to exceed a right outermost line 67.

The left and right outermost lines 66 and 67 are previously stored by the controller 36. The left and right outermost lines 66 and 67 are determined, for example, in accordance with the width of the vehicle body 2. Alternatively, the left and right outermost lines 66 and 67 may be determined in accordance with the width of the tooth 56. The angle between the left limit line 64 and the right limit line 65 is a fixed value that corresponds to the sensor properties of the object sensor 42. The position of the detection determination range 60 changes in response to changes in the position and orientation of the object sensor 42.

When the tooth 56 is rotated to the left and right as illustrated in FIG. 9, the controller 36 modifies the orientation of the object sensor 42 by means of the direction modification device 43 in accordance with the sensor attitude data, thereby modifying the detection determination range 60 as illustrated in FIG. 10. The controller 36 modifies the orientation in the left-right direction of the object sensor 42 by means of the direction modification device 43 so as to cancel the sensor angle λ brought about by the rotation of the tooth 56. That is, the controller 36 causes the object sensor 42 to be rotated in the direction opposite to the rotating direction of the tooth 56 so that the sensor angle λ becomes zero. Consequently, the detection determination range 60 is set as illustrated in FIG. 10. The processing in steps S4 and S5 are the same as in the abovementioned first embodiment.

In the detection method for an object according to the second embodiment as explained above, the controller 36 modifies the orientation of the object sensor 42 in the left-right direction by means of the direction modification device 43 in accordance with the change in the orientation of the object sensor 42 in the left-right direction brought about by the change in the attitude of the second work implement 4, thereby modifying the detection determination range 60. As a result, an increase in the blind spot of the detection determination range 60 is suppressed even if the attitude of the second work implement 4 changes. Consequently, an object in the periphery of the work machine 1 can be appropriately detected.

Figure 11:
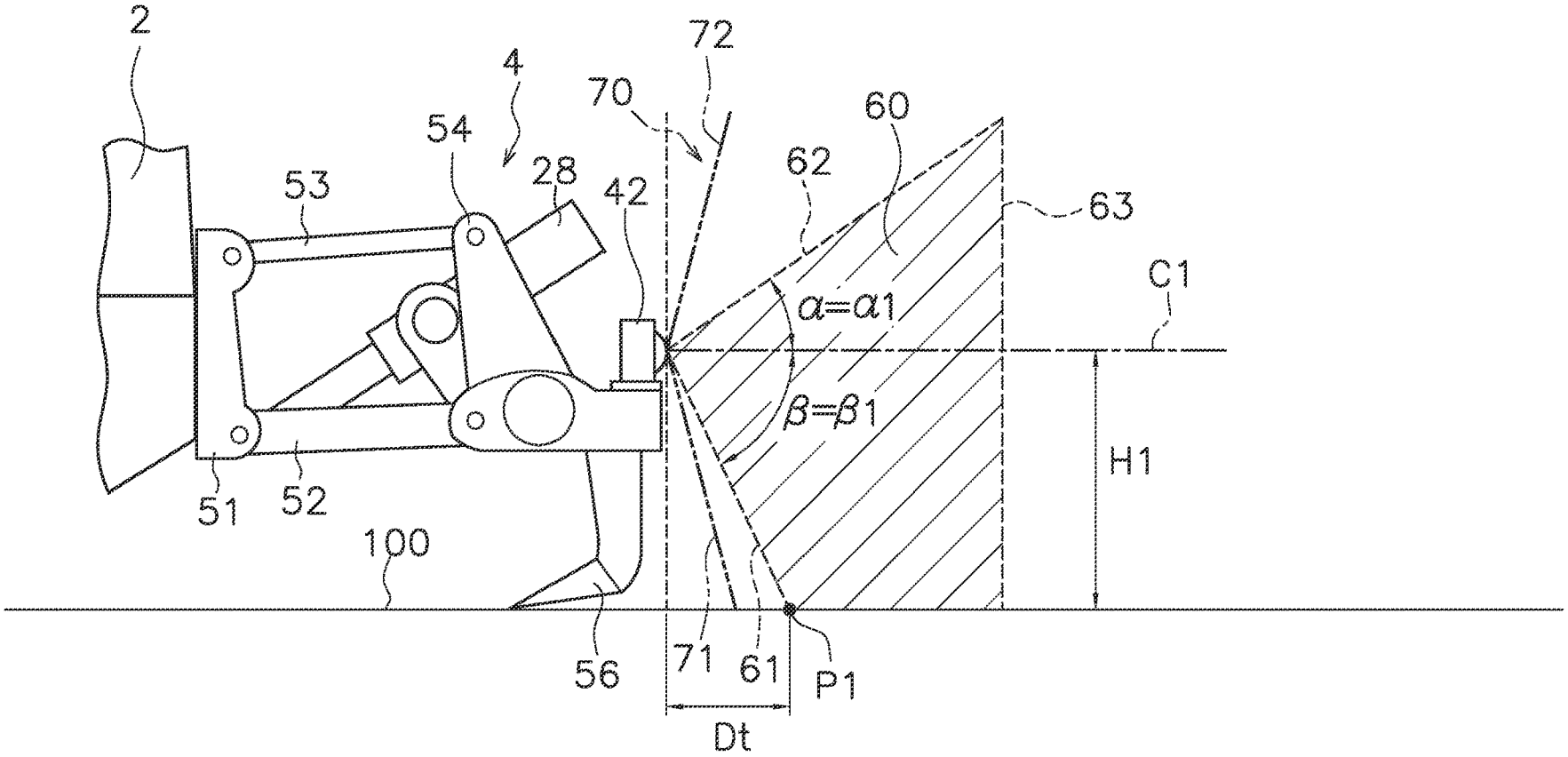
FIG. 11 is a side view illustrating the detection determination range according to a third embodiment.
Figure 12:
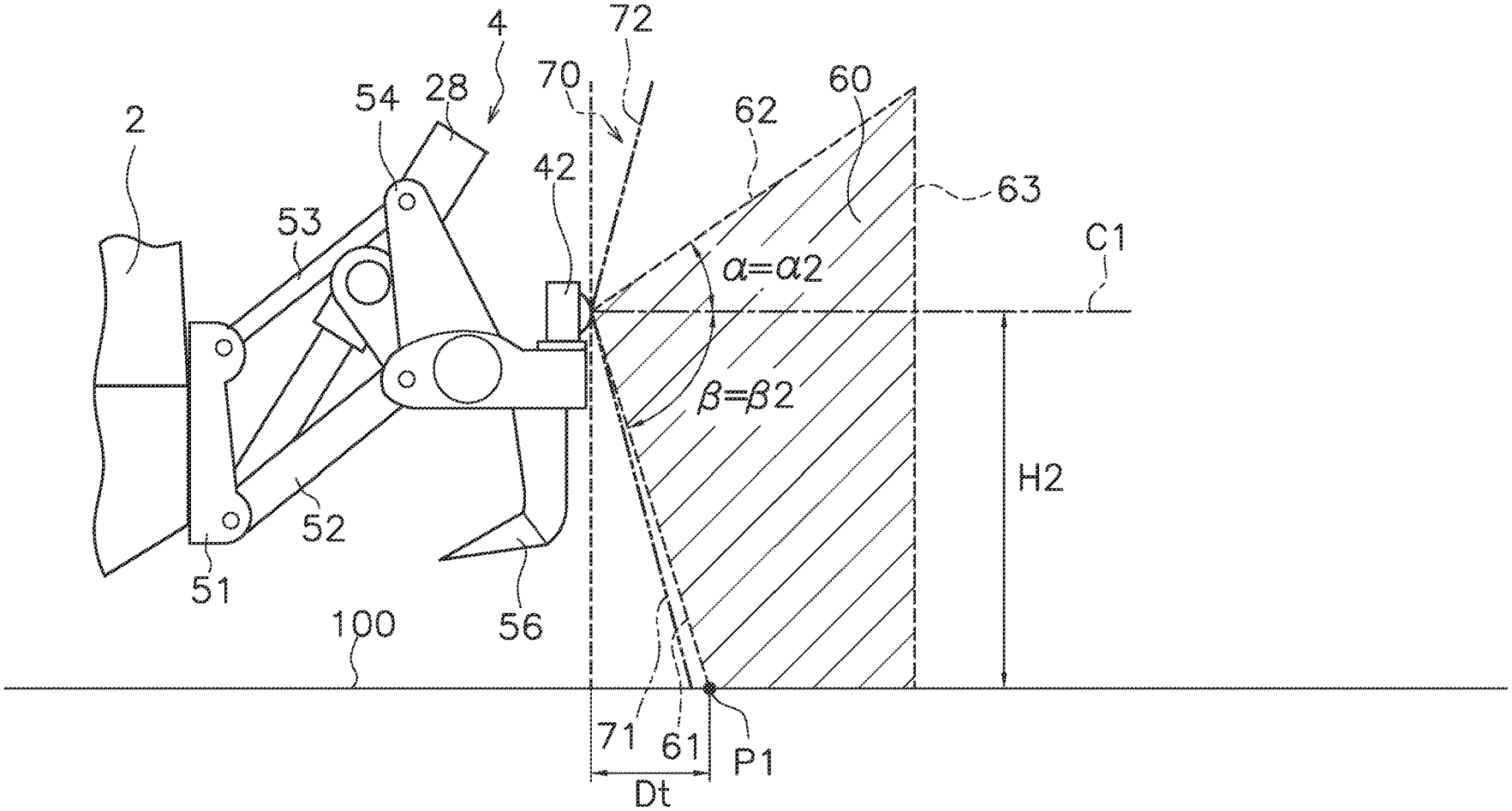
FIG. 12 is a side view illustrating the detection determination range according to the third embodiment.

Next, a detection method of an object according to a third embodiment will be explained below. FIGS. 11 and 12 are side views illustrating the detection determination range 60 according to the third embodiment. The flow chart that illustrates the detection method for the object according to the third embodiment is the same as the flow chart that illustrates the detection method for the object according to the first embodiment illustrated in FIG. 4.

In step S1, the controller 36 acquires the work implement attitude data. As illustrated in FIGS. 11 and 12, the tooth 56 of the second work implement 4 (ripper) moves upward and downward due to an operation by the operator in the same way as in the first embodiment. The tooth 56 is moved up and down. Therefore, in the third embodiment, the work implement attitude data indicates the height of the tooth 56.

In step S2, the controller 36 calculates the sensor attitude data. As illustrated in FIG. 11, the sensor attitude data indicates the height H1 of the object sensor 42. The controller 36 calculates the height H1 of the object sensor 42 as the sensor attitude data based on the work implement attitude data.

In step S3, the controller 36 sets the detection determination range 60. As illustrated in FIG. 11, the object sensor 42 detects an object in a detectable range 70. The detectable range 70 includes a lower limit line 71 and an upper limit line 72. The lower limit line 71 indicates the boundary position below the detectable range 70. The upper limit line 72 indicates the boundary position above the detectable range 70.

The controller 36 sets the detection determination range 60 within the detectable range 70. The controller 36 sets the detection determination range 60 within the detectable range 70 in accordance with the height of the object sensor 42 indicated by the sensor attitude data. The detection determination range 60 includes an upper limit angle α and a lower limit angle β. The upper limit angle α is the angle of the upper limit line 62 with respect to the center axis C1 of the object sensor 42 as seen in a side view of the vehicle. The lower limit angle β is the angle of the lower limit line 61 with respect to the center axis C1 of the object sensor 42 as seen in a side view of the vehicle.

The controller 36 calculates a target angle β1 of the lower limit angle β in which the distance from the object sensor 42 to a point P1 where the lower limit line 61 and the ground surface 100 intersect, becomes the target distance Dt. The controller 36 calculates the target angle β1 of the lower limit angle β from the height H1 of the object sensor 42 and the target distance Dt.

As illustrated in FIG. 12, when the tooth 56 rises and the height of the object sensor 42 changes from H1 to H2, the controller 36 modifies the detection determination range 60 within the detectable range 70 in accordance with the height H2. The controller 36 calculates the target angle β2 of the lower limit angle β from the height H2 of the object sensor 42 and the target distance Dt.

The upper limit angle α may be fixed value. In this case, the target angle α1 of the upper limit angle illustrated in FIG. 11 is the same as the target angle α2 of the upper limit angle illustrated in FIG. 12. The upper limit angle α may be determined in accordance with the sensor properties of the object sensor 42. Alternatively, the upper limit angle α may be variable. The upper limit angle α is not limited to an angle of elevation and may be an angle of dip.

As described above, the detection determination range 60 is set within the detectable range 70 as illustrated in FIG. 12. The processing in steps S4 and S5 are the same as in the abovementioned first embodiment.

In the detection method for an object according to the third embodiment as explained above, the controller 36 sets the detection determination range 60 within the detectable range 70 so as to modify the orientation of the object sensor 42 in the up-down direction in accordance with the change in the height of the object sensor 42 brought about by the change in the attitude of the second work implement 4. As a result, an increase in the blind spot of the detection determination range 60 is suppressed even if the attitude of the second work implement 4 changes. Consequently, an object in the periphery of the work machine 1 can be appropriately detected.

Figure 13:
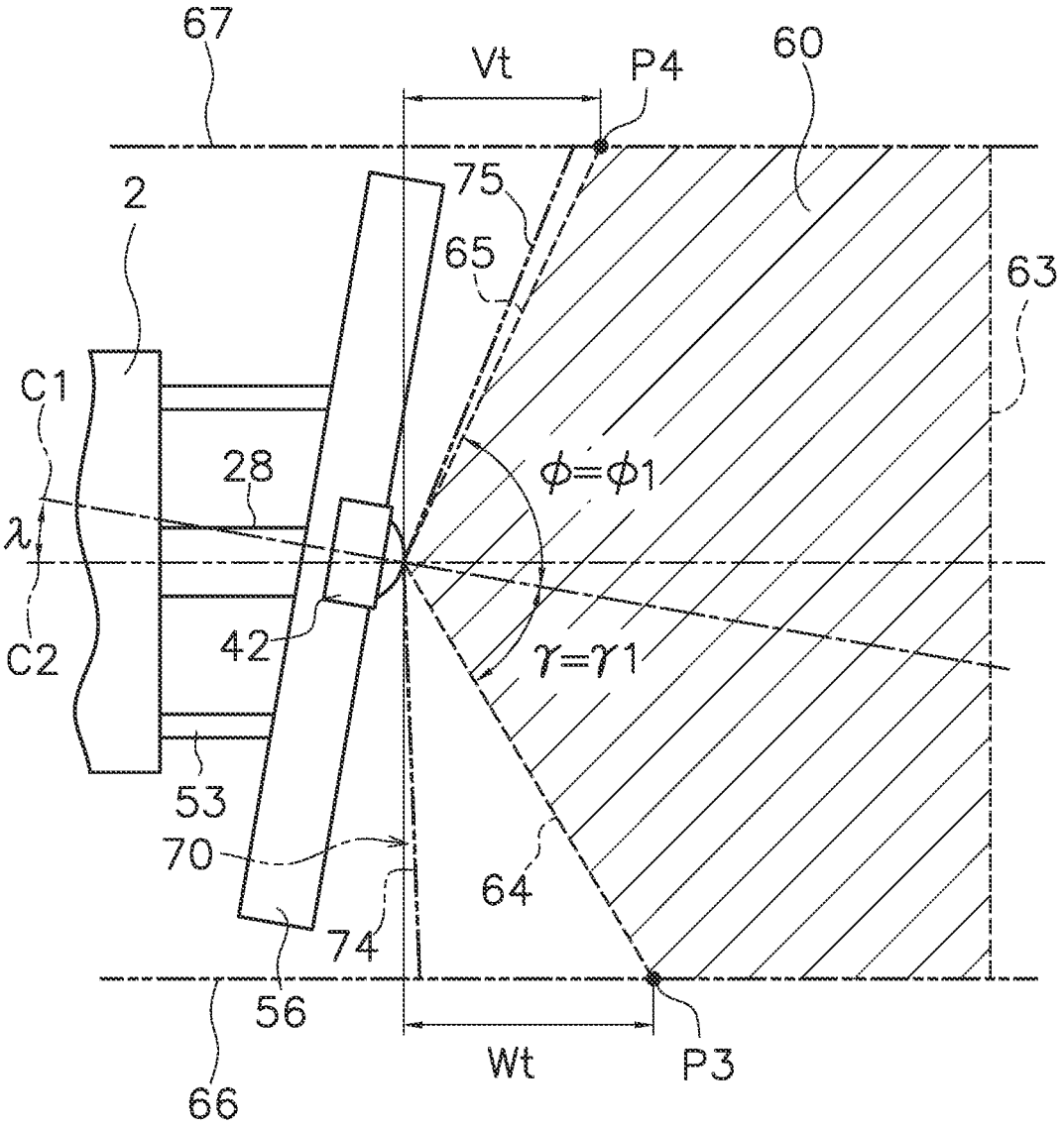
FIG. 13 is a top view illustrating the detection determination range according to a fourth embodiment.

Next, a detection method of an object according to a fourth embodiment will be explained below. FIG. 13 is a top view illustrating the detection determination range 60 according to the fourth embodiment. The flow chart that illustrates the detection method for the object according to the fourth embodiment is the same as the flow chart that illustrates the detection method for the object according to the first embodiment illustrated in FIG. 4.

In step S1, the controller 36 acquires the work implement attitude data. The tooth 56 of the second work implement 4 (ripper) rotates to the left and right due to an operation by the operator in the same way as in the second embodiment. Therefore, in the fourth embodiment, the work implement attitude data indicates the orientation of the tooth 56 in the left-right direction in the same way as in the second embodiment. In step S2, the controller 36 calculates the sensor attitude data. The sensor attitude data indicates the sensor angle λ of the object sensor 42 in the same way as in the second embodiment.

In step S3, the controller 36 sets the detection determination range 60. The controller 36 sets the detection determination range 60 within the detectable range 70. The detectable range 70 includes a left limit line 74 and a right limit line 75. The left limit line 74 indicates the boundary position to the left of the detectable range 70. The right limit line 75 indicates the boundary position to the right of the detectable range 70.

The detection determination range 60 has a left angle limit γ and a right angle limit φ. The left angle limit γ is the angle between the center axis C1 of the object sensor 42 and the left limit line 64 of the detection determination range 60. The right angle limit φ is the angle between the center axis C1 of the object sensor 42 and the right limit line 65 of the detection determination range 60.

The controller 36 calculates a target angle γ1 of the left angle limit γ and a target angle φ1 of the right angle limit φ in accordance with the orientation of the object sensor 42 indicated by the sensor attitude data. The controller 36 calculates the target angle γ1 of the left angle limit γ so that the distance from the object sensor 42 to a point P3 where the left limit line 64 and the left outermost line 66 intersect in a vehicle top view, becomes a target distance Wt. The controller 36 calculates the target angle φ1 of the right angle limit φ so that the distance from the object sensor 42 to a point P4 where the right limit line 65 and the right outermost line 67 intersect in a vehicle top view, becomes a target distance Vt. The target distances Wt and Vt are, for example, fixed values and are stored by the controller 36. The target distances Wt and Vt may be variable.

When the tooth 56 rotates to the left or right, the controller 36 sets the detection determination range 60 within the detectable range 70 so as to cancel the sensor angle λ brought about by the rotation of the tooth 56. That is, the controller 36 modifies the left angle limit γ of the detection determination range 60 so that the distance from the object sensor 42 to the point P3 is maintained at the target distance Wt even if the sensor angle λ is changed. Similarly, the controller 36 modifies the right angle limit φ of the detection determination range 60 so that the distance from the object sensor 42 to the point P3 is maintained at the target distance Vt even if the sensor angle λ is changed. Consequently, the detection determination range 60 is set as illustrated in FIG. 13. The processing in steps S4 and S5 are the same as in the abovementioned first embodiment.

In the detection method for an object according to the fourth embodiment as explained above, the controller 36 sets the detection determination range 60 within the detectable range 70 so as to modify the orientation of the detection determination range 60 in the left-right direction in accordance with the change in the orientation of the object sensor 42 in the left-right direction brought about by the change in the attitude of the second work implement 4. As a result, an increase in the blind spot of the detection determination range 60 is suppressed even if the attitude of the second work implement 4 changes. Consequently, an object in the periphery of the work machine 1 can be appropriately detected.

Although embodiments of the present invention have been described so far, the present invention is not limited to the above embodiments and various modifications may be made within the scope of the invention.

The work machine 1 is not limited to a motor grader and may be another type of work machine. The configuration of the work machine 1 is not limited to the above embodiment and may be modified. For example, the configuration of the first work implement 3 may be modified. The configuration of the second work implement 4 may be modified. For example, the second work implement 4 is not limited to a ripper and may include another work implement such as a blade or a bucket. The second work implement 4 may be attached further toward the front than the front end of the vehicle body 2 and the object sensor 42 may be configured so as to detect an obstacle in front of the work machine 1. Typically, the present invention may be applied to a bulldozer having a blade at the front of the vehicle body.

A portion of the control system of the work machine 1 may be disposed outside of the work machine 1. For example, the operating device 35 may be disposed outside the work machine 1. The output device 44 may be disposed outside of the work machine 1.

The controller 36 may be configured by a plurality of controllers. The abovementioned processing may be distributed and executed among the plurality of controllers. In such a case, a portion of the plurality of controllers may be disposed outside of the work machine 1.

The process when an object is detected in the detection determination range 60 is not limited to the above embodiments and may be modified. For example, when an object is detected in the detection determination range 60, the controller 36 may perform a process for stopping or limiting the motion of the second work implement 4 and/or the vehicle body 2.

The detection determination range 60 is not limited to the rear of the vehicle body 2 and may be set in front of the vehicle body 2. The detection determination ranges 60 may be set to both the front and the rear of the vehicle body 2. The detection determination range 60 may be set to the lateral side of the vehicle body 2.

According to the present invention, a wide detection range for an object sensor can be assured and an object can be appropriately detected in the periphery of the work machine even if the attitude of the work implement changes.

The invention claimed is:

1. A work machine comprising:

a vehicle body;

a work implement movably attached to the vehicle body;

an attitude sensor configured to detect an attitude of the work implement;

an object sensor attached to the work implement, the object sensor being configured to detect an object in a periphery of the work machine, the object sensor being configured to detect the object in a detectable range of the object sensor, and output a signal indicating a presence of the object; and a controller configured to set a detection determination range of the object sensor within the detectable range, determine the presence of the object in the detection determination range based on the signal from the object sensor, and calculate sensor attitude data including a height of the object sensor and at least one of a position and an orientation of the object sensor, based on the attitude of the work implement, the controller being configured to set the detection determination range in accordance with the sensor attitude data such that the detection determination range is modified in accordance with a change in the height of the object sensor caused by a change in the attitude of the work implement.

2. The work machine according to claim 1, wherein the sensor attitude data includes the position of the object sensor, and the controller is configured to modify the detection determination range so as to reduce a change of the detection determination range due to a change of the position of the object sensor.

3. The work machine according to claim 1, wherein the sensor attitude data includes the orientation of the object sensor, and the controller is configured to modify the detection determination range so as to reduce a change of the detection determination range due to a change of the orientation of the object sensor.

4. The work machine according to claim 1, further comprising:

a direction modification device connected to the object sensor, the direction modification device being configured to change the orientation of the object sensor, the controller being configured to modify the orientation of the object sensor using the direction modification device in accordance with the sensor attitude data to modify the detection determination range.

5. The work machine according to claim 4, wherein the controller is configured to modify the orientation of the object sensor in an up-down direction using the direction modification device in accordance with the height of the object sensor to modify the detection determination range.

6. The work machine according to claim 4, wherein the sensor attitude data includes the orientation of the object sensor in a left-right direction, and the controller is configured to modify the orientation of the object sensor in the left-right direction using the direction modification device in accordance with a change in the orientation in the left-right direction of the object sensor brought about by a change in the attitude of the work implement to modify the detection determination range.

7. The work machine according to claim 1, wherein the controller is configured to set the detection determination range such that the detection determination range is modified in an up-down direction within the detectable range in accordance with the change in the height of the object sensor.

8. The work machine according to claim 1, wherein the sensor attitude data includes the orientation of the object sensor in a left-right direction, and the controller is configured to set the detection determination range so as to modify the detection determination range in the left-right direction within the detectable range in accordance with a change in the orientation of the object sensor in the left-right direction due to a change in the attitude of the work implement.

9. A method for controlling a work machine, the work machine including a vehicle body, a work implement movably attached to the vehicle body, and an object sensor that is attached to the work implement, detects an object in a periphery of the work machine, and outputs a signal indicating a presence of the object, the object sensor being configured to detect the object in a detectable range of the object sensor, the method comprising:

detecting an attitude of the work implement;

setting a detection determination range of the object sensor within the detectable range;

determining the presence of the object in the detection determination range based on the signal output by the object sensor; and calculating sensor attitude data that includes a height of the object sensor and at least one of a position and an orientation of the object sensor, based on the attitude of the work implement, the detection determination range being set in accordance with the sensor attitude data such that the detection determination range is modified in accordance with a change in the height of the object sensor caused by a change in the attitude of the work implement.

10. The method according to claim 9, wherein the sensor attitude data includes the position of the object sensor, and the method further comprises modifying the detection determination range so as to reduce a change of the detection determination range due to a change of the position of the object sensor.

11. The method according to claim 9, wherein the sensor attitude data includes the orientation of the object sensor, and the method further comprises modifying the detection determination range so as to reduce a change of the detection determination range due to a change of the orientation of the object sensor.

12. The method according to claim 9, further comprising:

modifying the detection determination range by modifying the orientation of the object sensor in accordance with the sensor attitude data.

13. The method according to claim 12, wherein the method further comprises modifying the orientation of the object sensor in an up-down direction in accordance with the height of the object sensor to modify the detection determination range.

14. The method according to claim 12, wherein the sensor attitude data includes the orientation of the object sensor in a left-right direction, and the method further comprises modifying the orientation of the object sensor in the left-right direction in accordance with a change in the orientation of the object sensor in the left-right direction brought about by a change in the attitude of the work implement to modify the detection determination range.

15. The method according to claim 9, wherein the detection determination range is set such that the detection determination range is modified in an up-down direction within the detectable range in accordance with the change in the height of the object sensor.

16. The method according to claim 9, wherein the sensor attitude data includes the orientation of the object sensor in a left-right direction, and the method further comprises setting the detection determination range so as to modify the detection determination range in the left-right direction within the detectable range in accordance with a change in the orientation of the object sensor in the left-right direction due to a change in the attitude of the work implement.

17. A control system for a work machine, the work machine including a vehicle body and a work implement movably attached to the vehicle body, the control system comprising:

an attitude sensor configured to detect an attitude of the work implement;

an object sensor attached to the work implement, the object sensor being configured to detect an object in a periphery of the work machine, the object sensor being configured to detect the object in a detectable range of the object sensor, and output outputs a signal indicating a presence of the object; and a controller configured to set a detection determination range of the object sensor within the detectable range, determine the presence of the object in the detection determination range based on the signal from the object sensor, and calculate sensor attitude data that includes a height of the object sensor and at least one of a position and an orientation of the object sensor, based on the attitude of the work implement, the controller being configured to set the detection determination range in accordance with the sensor attitude data such that the detection determination range is modified in accordance with a change in the height of the object sensor caused by a change in the attitude of the work implement.

* * * * *